US009272227B2

(12) United States Patent
Tanous

(10) Patent No.: US 9,272,227 B2
(45) Date of Patent: Mar. 1, 2016

(54) FLYING TOY SPACECRAFT

(71) Applicant: Gregory David Tanous, Forest Grove, OR (US)

(72) Inventor: Gregory David Tanous, Forest Grove, OR (US)

(73) Assignee: Tanous Works, LLC, Simpsonville, SC (US)

( * ) Notice: Subject to any disclaimer, the term of this patent is extended or adjusted under 35 U.S.C. 154(b) by 0 days.

(21) Appl. No.: 14/594,992

(22) Filed: Jan. 12, 2015

(65) Prior Publication Data

US 2015/0196849 A1 Jul. 16, 2015

Related U.S. Application Data

(60) Provisional application No. 61/925,682, filed on Jan. 10, 2014.

(51) Int. Cl.
*A63H 27/00* (2006.01)
*A63H 30/04* (2006.01)

(52) U.S. Cl.
CPC ..... *A63H 27/02* (2013.01); *A63H 30/04* (2013.01)

(58) Field of Classification Search
USPC ..... 446/34, 36, 37, 48, 57, 58, 59, 61, 63, 446/66
See application file for complete search history.

(56) References Cited

U.S. PATENT DOCUMENTS

| | | | | |
|---|---|---|---|---|
| 1,420,194 | A | 6/1922 | Howard | |
| 2,514,478 | A | 8/1947 | Custer | |
| 4,103,454 | A | 8/1978 | Stone | |
| 4,345,401 | A * | 8/1982 | Brzack | A63H 27/00 244/13 |
| 4,458,442 | A | 7/1984 | McDaniel | |
| 5,908,341 | A * | 6/1999 | dasa | A63H 27/00 446/61 |
| 6,306,004 | B1 * | 10/2001 | Farrar | A63H 27/00 446/61 |
| 6,435,932 | B1 * | 8/2002 | Lynn | A63H 27/00 446/30 |
| 6,450,852 | B1 * | 9/2002 | Arredondo | A63H 27/00 244/154 |
| 7,971,824 | B2 * | 7/2011 | Van de Rostyne | A63H 27/00 244/35 R |
| 8,182,306 | B2 * | 5/2012 | Scarborough | A63H 27/00 244/12.2 |
| 8,348,714 | B2 * | 1/2013 | Newton | A63H 27/02 446/61 |
| 8,992,280 | B2 * | 3/2015 | Tanous | A63H 27/00 244/7 A |
| 2006/0084352 | A1 * | 4/2006 | Johnson | A63H 3/14 446/61 |
| 2006/0292957 | A1 * | 12/2006 | Howard | A63H 27/001 446/61 |
| 2007/0259595 | A1 * | 11/2007 | Amireh | A63H 27/02 446/57 |

FOREIGN PATENT DOCUMENTS

| | | |
|---|---|---|
| WO | WO 03/076224 | 9/2003 |

* cited by examiner

*Primary Examiner* — Kurt Fernstrom
(74) *Attorney, Agent, or Firm* — Stephen E. Kelly; Rogers Towers, P.A.

(57) ABSTRACT

A flying toy spacecraft having one or more low pressure channels acting as the primary lift mechanism. Each of the low pressure channels has a bottom member, two sidewalls, and an optional top member. The interior of the channel can be fitted with an airfoil or a trailing reflexed edge. In embodiments having two or more low pressure channels, the channels are spaced apart, thereby forming an inverted channel that stabilizes the flying toy spacecraft against undesired yawing motions.

2 Claims, 12 Drawing Sheets

FLYING TOY SPACECRAFT

CROSS-REFERENCE TO RELATED APPLICATION

Pursuant to 35 U.S.C. §119(e), this application claims the benefit of U.S. Provisional Patent Application Ser. No. 61/925,682, filed on Jan. 10, 2014, the entire contents of which is incorporated herein by this reference.

BACKGROUND

1. Field of Invention

The present invention relates generally to the field of remote controlled flying toys, and more particularly, to a flying or gliding toy spacecraft having a low pressure channel as the main lift element.

2. Description of Related Art

Radio controlled (RC) flying toys have been used for many years as an enjoyable source of entertainment. However, proper functionality of these toys demands a precise balance between weight, lift, and power. The weight of the toy depends on its size, shape, and construction. The lift of the toy depends on the size, shape, and orientation of the wings. Adding more wings or larger wings to increase lift causes a corresponding increase in weight, thus requiring more lift for the toy to function properly.

Although there are many flying toy airplanes and gliders, the development of more fanciful flying toys has been limited by the problem of the weight/lift balance. Fanciful toys such as spacecraft do not always have pronounced wings in a manner similar to that of airplanes. Some toy spacecraft could fly with increased power provided by the propulsion system. However, larger motors or larger, more powerful power supplies (such as batteries) also add weight to the toy, thereby demanding more lift for proper functionality.

The present invention seeks to overcome these problems by providing a low pressure channel as a lift mechanism, thereby enabling controlled flight of the radio controlled toy spacecraft.

SUMMARY

The flying toy spacecraft comprises a body having one or more low pressure channels, a control system, and a propulsion system. The low pressure channel is generally defined by a base member and two sidewalls, one of each of which sidewalls is connected to the base member along the side of the base member. In one embodiment, the low pressure channel further comprises a top member that attaches to the sidewalls. The leading section of the channel is located near the front of the flying toy spacecraft, and the leading section acts as the air intake for air to pass through the low pressure channel as the toy spacecraft glides during flight. The trailing section is located near the back portion of the flying toy spacecraft.

Additional features of the low pressure channel could include an air foil located in the leading section, a reflexed edge located in the trailing section. The reflexed edge is either fixed in a reflexive position, or it can be movable as desired, therefore acting like an elevator in the trailing section of the channel.

The optional top member comprises either a solid member or a mesh member, or both. In one embodiment, aerodynamic functionality of the low pressure channel is enhanced when the top member comprises a solid member in the vicinity of the leading section of the channel. In this embodiment, the solid member extends only partially along the length of the body toward the trailing section. The remainder of the top member comprises a mesh member. In another embodiment, the entire top member consists of a mesh member.

In one embodiment, the flying toy spacecraft comprises at least two channels wherein the adjacent interior sidewalls are spaced apart. This orientation of adjacent interior sidewalls is configured to form an inverse channel along the underside of the flying toy spacecraft. The inverse channel is defined on its sides by the interior sidewalls connected by the top member. It is advantageous for the interior sidewalls to be aligned substantially parallel to the longitudinal axis of the flying toy spacecraft such that the interior sidewalls act as aerodynamic guide members that assist in stabilizing the flying toy spacecraft from undesired yawing motion during flight.

The control system comprises the electronic components for operation of the low pressure channel or the flying toy spacecraft. The control system typically comprises a receiver, a power source such as a battery, a circuit board, and other electronic components and wiring necessary to create electrical connectivity between the receiver, power source, and the propulsion units.

In one embodiment of the operation of the flying toy spacecraft, the propulsion system comprises two propulsion units. The propulsion units are independently operable to promote a greater degree of steering and control by the user. An increase or decrease in power causes a corresponding increase or decrease in the thrust produced by the first propulsion unit, thereby creating a thrust differential between the first propulsion unit and a second propulsion unit. This thrust differential forces the toy spacecraft to turn to in the opposite direction.

The propulsion system can comprise more than two propulsion units. However, the arrangement of propulsion units should comprise at least one propulsion unit attached to the flying toy figure on each side of the longitudinal axis.

DETAILED DESCRIPTION

Figure 1:
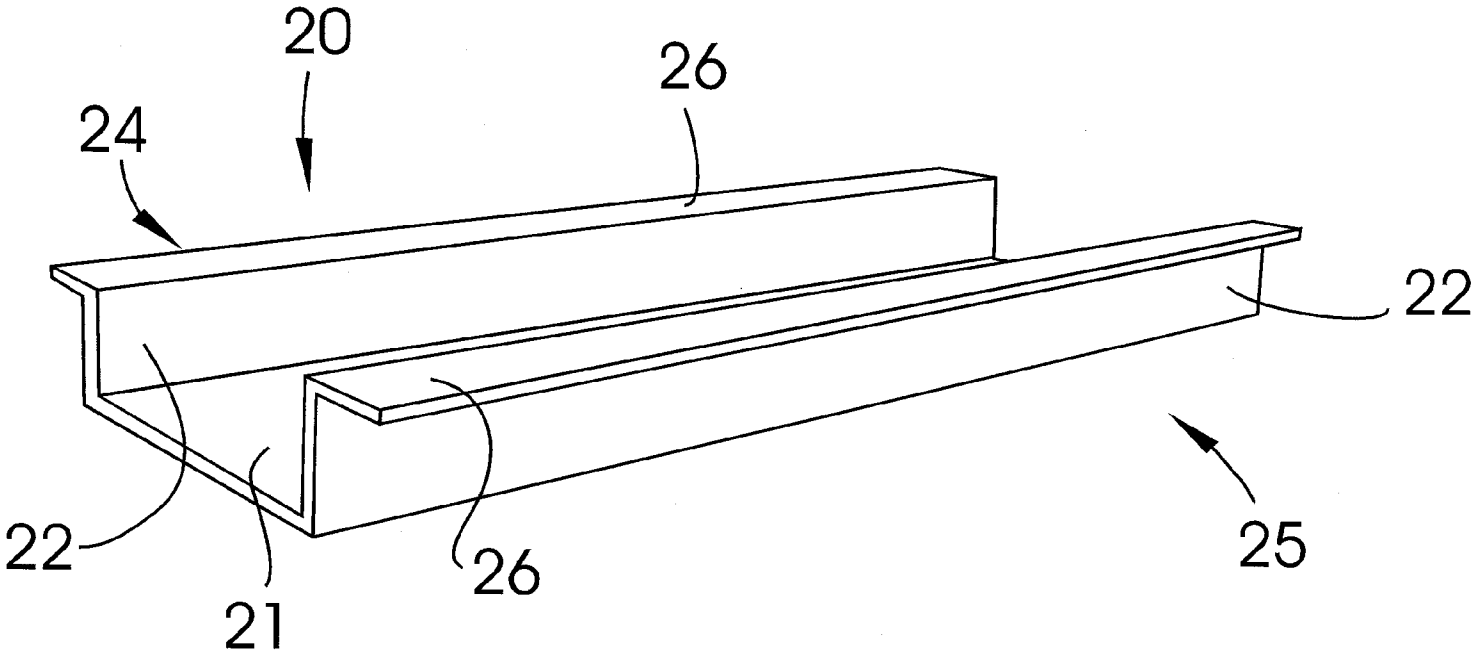
FIG. 1 is an isometric view of a typical low pressure channel.
Figure 2:
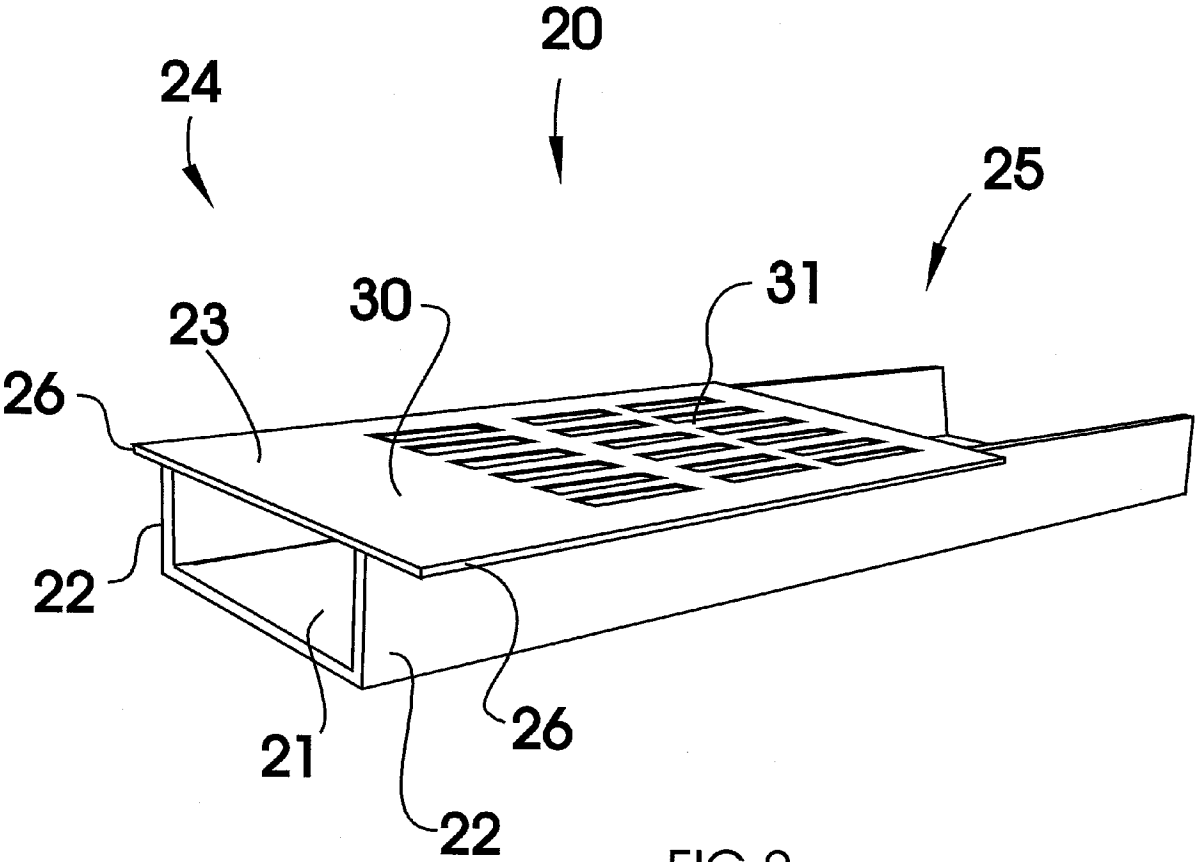
FIG. 2 is an isometric view of a typical low pressure channel, showing the top member with a mesh section.
Figure 3:
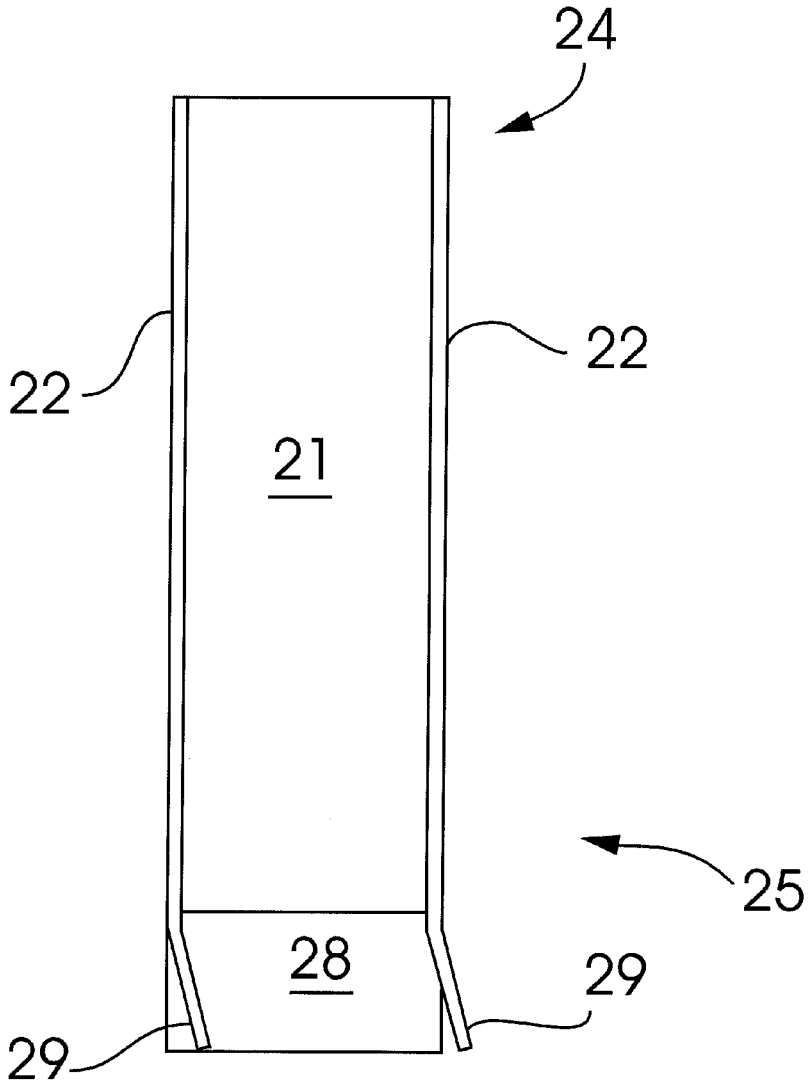
FIG. 3 is a top view of one embodiment of a low pressure channel having rudder members placed at the trailing section.

With reference to the drawings, the invention will now be described with regard for the best mode and the preferred embodiment. In general, the device disclosed herein is a remote controlled, flying toy spacecraft having an improved lift mechanism comprising one or more low pressure channels. The embodiments disclosed herein are meant for illustration and not limitation of the invention. An ordinary practitioner will appreciate that it is possible to create many variations of the following embodiments without undue experimentation.

The flying toy spacecraft 1 is generally controlled by a wireless control device 5 having a transmitter to transmit an electronic signal to a control system 50 of the flying toy spacecraft 1. The control system 50 controls a propulsion system 60 on the flying toy spacecraft 1 to produce a gliding form of flight, as discussed below. As used herein, the terms "right," "left," "forward," "rearward," "top," "bottom," and similar directional terms refer to orientations when facing the direction of flight of the toy spacecraft 1. The term "horizontal" means a plane or direction generally parallel to the ground or other surface above which the flying toy spacecraft 1 is flying. The term "vertical" means the plane or direction generally perpendicular to the ground or other surface above which the flying toy spacecraft 1 is flying. The term "longitudinal axis" means the axis about which the flying toy spacecraft 1 rolls. The term "electronic signal" means any wireless electromagnetic signal transmitted from the wireless control device 5 to the control system 50 for controlling the flying toy spacecraft 1. In one embodiment, the electronic signal is a radio frequency signal typical for radio controlled (RC) toys.

Referring to the Figures, the flying toy spacecraft 1 comprises a body 10 having one or more low pressure channels 20, a control system 50, and a propulsion system 60. The one or more low pressure channels 20 are configured to produce lift during flight of the spacecraft 1, as discussed below. The spacecraft 1 is made of lightweight material common in the RC toy industry, such as cardboard, foam, foam board, or the like. Referring to FIGS. 1-6, the low pressure channel 20 is a shallow, elongated channel oriented generally parallel to the longitudinal axis 11 of the flying toy spacecraft 1. The low pressure channel 20 is generally defined by a base member 21 and two sidewalls 22, one of each of which sidewalls 22 is connected to the base member 21 either continuously or discontinuously along the side of the base member 21. In one embodiment, the low pressure channel 20 further comprises a top member 23 that attaches to the sidewalls 22, extending fully or partially along the length of the base member 21. The low pressure channel 20 has a leading section 24 and a trailing section 25. The leading section 21 is located near the front of the flying toy spacecraft 1, and the leading section 21 acts as the air intake for air to pass through the low pressure channel 20 as the toy spacecraft 1 glides during flight. The trailing section 25 is located near the back portion of the flying toy spacecraft 1.

Figure 4:
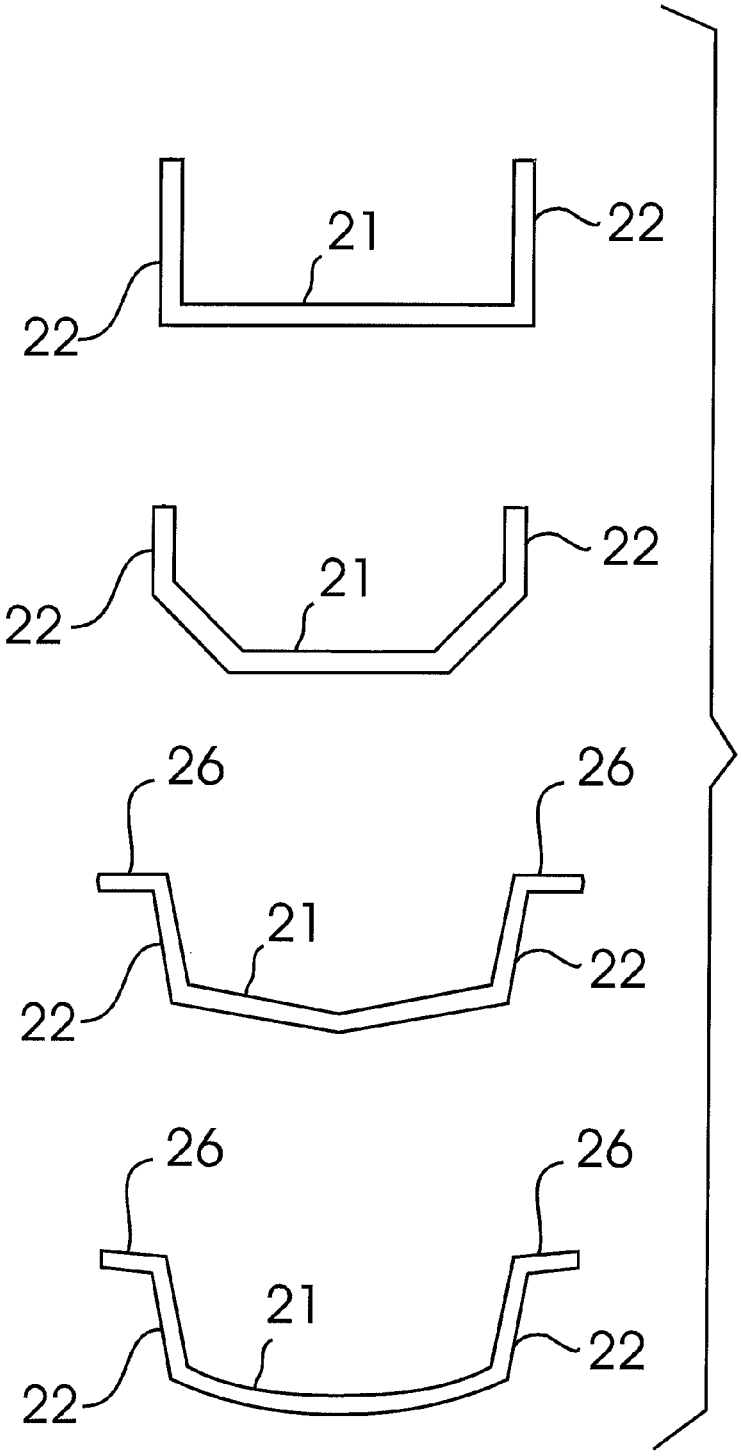
FIG. 4 shows cross sections of the shapes of various low pressure channel embodiments.
Figure 5:
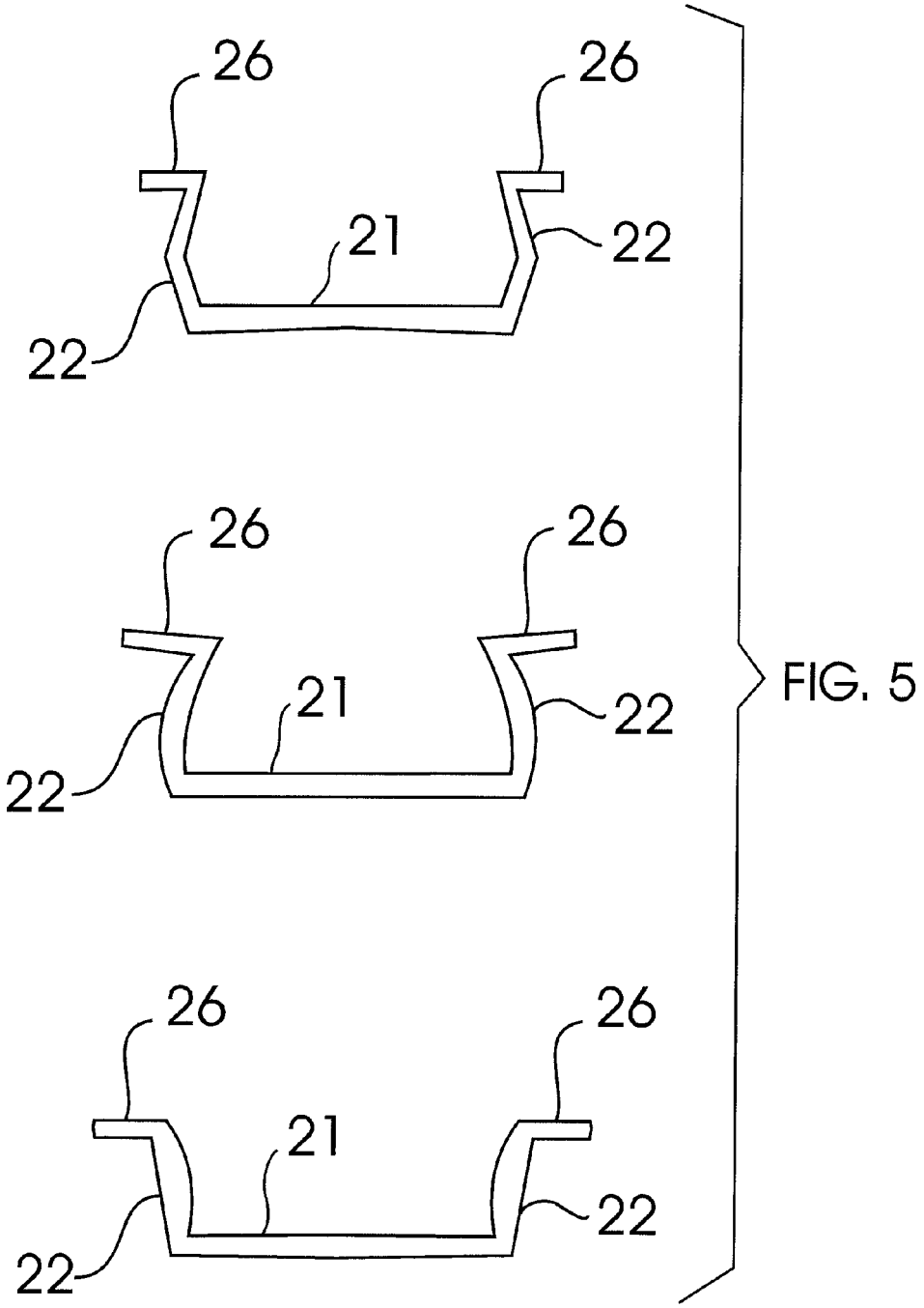
FIG. 5 shows cross sections of the shapes of various low pressure channel embodiments.

Referring to FIGS. 4 and 5, the base member 21 could be a flat member, or it could have a cross sectional shape in the form of a V-shape, a U-shape, a partial hexagon, or some other shape. The sidewalls 22 could also be straight, or they could be concave or convex with respect to the interior of the channel 20. The cross sectional shape of the sidewalls 22 also accommodates various geometric forms, as shown in the FIGS. 4 and 5. The base member 21 and the sidewalls could have a constant thickness or a variable thickness. A variable thickness of these members could be oriented to as to constrict or expand the air passage way through the channel 20. For example, the base member 21 or the sidewalls 22 or both could be arranged with a wall thickness that expands along the length of the channel 20 from the leading section 24 toward the trailing section 25. This variable wall thickness constricts the passage of the air flowing through the channel 20. As the airway constricts, the flow of air speeds up, and this higher air speed causes a further decrease in pressure and enhances the life effect created by the low pressure channel 20.

One or more embodiments of the low pressure channel 20 further comprises lateral wings 26 attached to the exterior of the sidewalls 22 and extending laterally away from the interior of the low pressure channel 20. The lateral wings 26 are configured to extend either continuously or discontinuously along the length of the sidewalls 22.

The dimensions of the low pressure channel 20 are variable along the length of the channel 20. For example, the low pressure channel 20 could deepen towards the trailing section 25 as compared to the leading section 24. This deepening is effected by increasing the height of the sidewalls 22 long the length of the low pressure channel 20. Alternately, the base member 21 could widen along the length of the low pressure channel 20, thereby spreading apart the distance between the sidewalls 22 and widening the channel 20.

Figure 6:
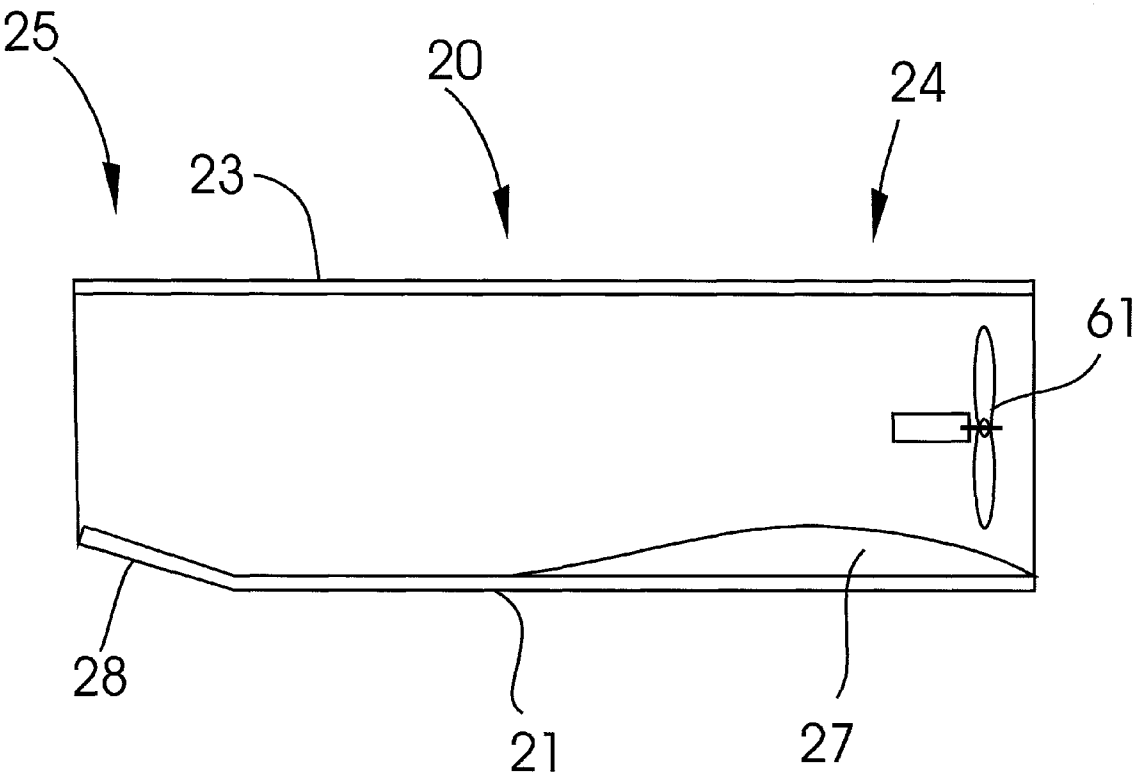
FIG. 6 shows a cross section of the elevation of one embodiment of a low pressure channel.

As shown in FIG. 6, additional embodiments of the low pressure channel 20 comprise additional features to enhance the aerodynamic lift effect generated by the channel 20. These additional features include an air foil 27 located in the leading section 24, a reflexed edge 28 located in the trailing section 25. The airfoil 27 is either permanently or removably affixed inside the low pressure channel 20 in the leading section 24, such as by attaching the airfoil 27 to the base member 21 or the sidewalls 22. A removable attachment between the airfoil 27 and the channel 20 comprises fastening members, such as hook and loop closures, clips, clasps, adhesives, or the like. The reflexed edge 28 is either fixed in a reflexive position, or it can be movable as desired, therefore acting like an elevator in the trailing section 25 of the channel 20.

In one embodiment of the sidewalls 22, either one or both of the sidewalls 22 comprise a rudder member 29 at the trailing section 25 of the channel 20. The rudder member 29 is controlled by a servo operable connected to the rudder member 29 and the control system 50.

Referring again to FIG. 2, the optional top member 23 comprises either a solid member 30 or a mesh member 31, or both. In one embodiment, aerodynamic functionality of the low pressure channel 20 is enhanced when the top member 23 comprises a solid member 30 in the vicinity of the leading section 24 of the channel 20. In this embodiment, the solid member 30 extends only partially along the length of the body 20 toward the trailing section 25. The remainder of the top member 23 comprises a mesh member 31. In another embodiment, the entire top member 23 consists of a mesh member 31. In either of these embodiments, it is not necessary for the top member 23 to extend the full length of the low pressure channel 20. In some embodiments, the mesh member 31 is situated above the reflexed edge 28. In this orientation, the reflexed edge 28 forces air up through the channel 20 and through the mesh member 31, thereby causing the channel 20 to pitch during flight.

Figure 7:
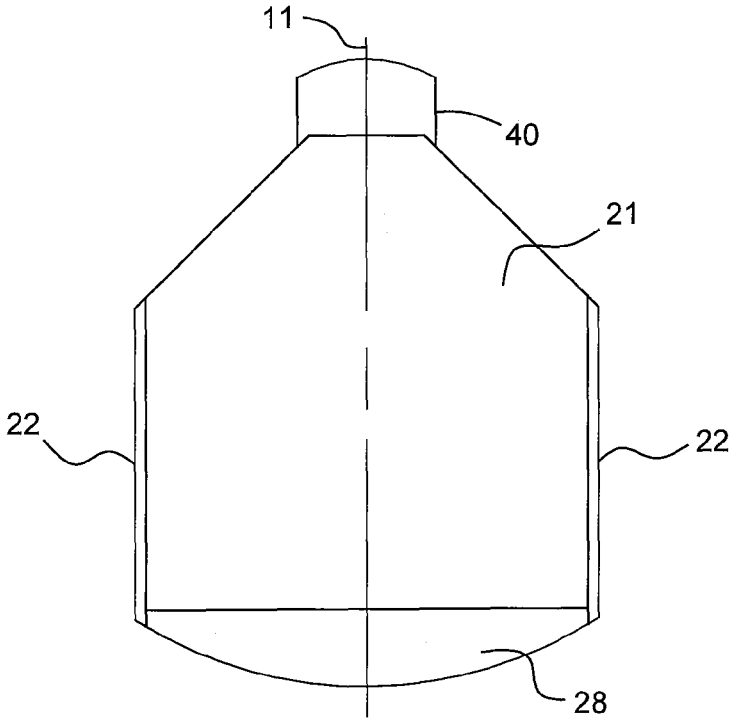
FIG. 7 is a top view of one embodiment of a flying toy spacecraft without a top member in place.
Figure 8:
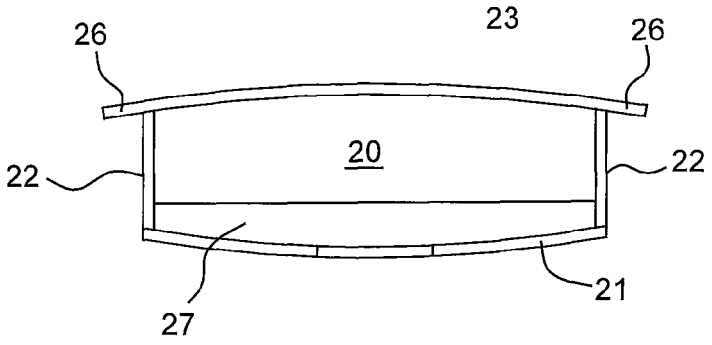
FIG. 8 is a front view of one embodiment of a flying toy spacecraft.
Figure 9:
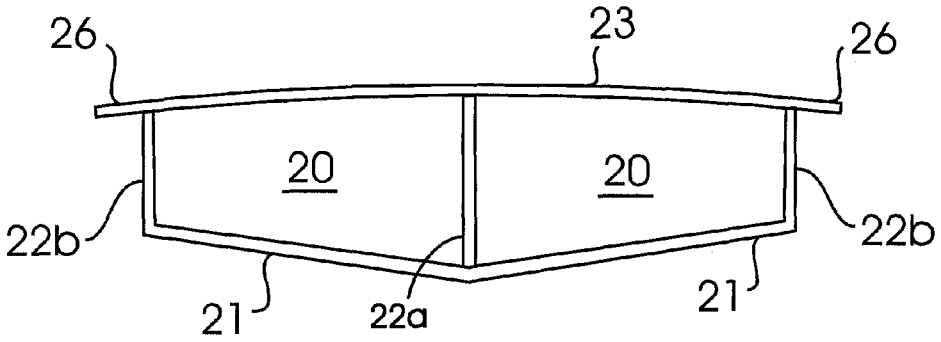
FIG. 9 is a cross section of an embodiment of a flying toy spacecraft having two low pressure channels.
Figure 12:
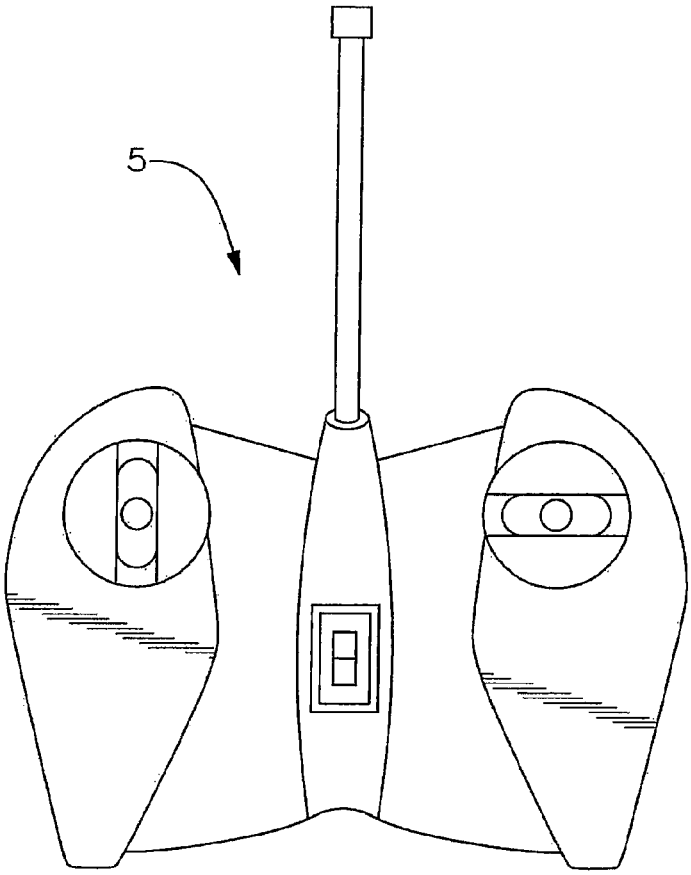
FIG. 12 is a top view of a typical wireless control device.

In one embodiment of the flying toy spacecraft 1 shown in FIGS. 7 and 8, the body 10 comprises one low pressure channel 20. In another embodiment shown in FIGS. 9 and 10, the spacecraft 1 comprises two low pressure channels 20. In one version of this embodiment, the low pressure channels 20 share an interior sidewall 22*a*, which can be longer or shorter than the exterior sidewalls 22*b*. In another variation of this embodiment, shown in FIG. 10, the interior sidewall 22*a* is deeper than the exterior sidewalls 22*b* such that the base member 21 takes the form of a dihedral shape, such as that shown in FIG. 9. In any of these embodiments, the low pressure channels 20 can increase in width along the length of the channel 20 from the leading section 24 to the trailing section 25, as shown in FIG. 12.

Figure 10:
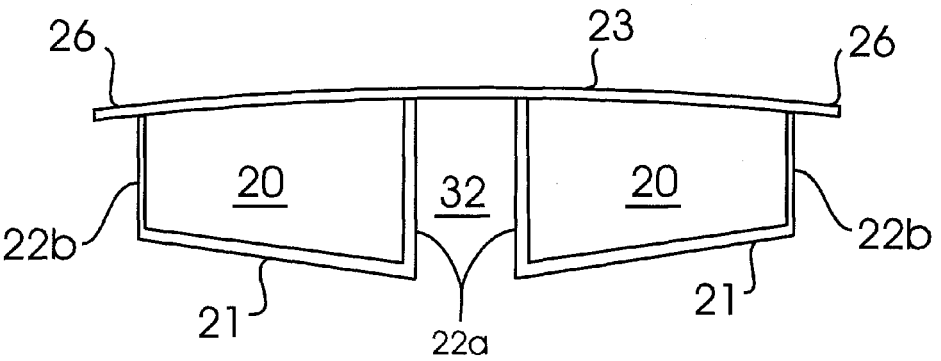
FIG. 10 is a cross section of an embodiment of a flying toy spacecraft having two low pressure channels and an inverse channel.

In one embodiment, as shown in FIG. 10, the flying toy spacecraft 1 comprises at least two channels 20 wherein the adjacent interior sidewalls 22*a* are spaced apart. This orientation of adjacent interior sidewalls 22*a* is configured to form an inverse channel 32 along the underside of the flying toy spacecraft 1. The inverse channel 32 is in the shape of an upside down U, an upside down V, or some similar shape. The inverse channel 32 is defined on its sides by the interior sidewalls 22*a* connected by the top member 23. It is advantageous for the interior sidewalls 22*a* to be aligned substantially parallel to the longitudinal axis 11 of the flying toy spacecraft 1 such that the interior sidewalls 22*a* act as aerodynamic guide members that assist in stabilizing the flying toy spacecraft 1 against undesired yawing motion during flight.

Figure 11:
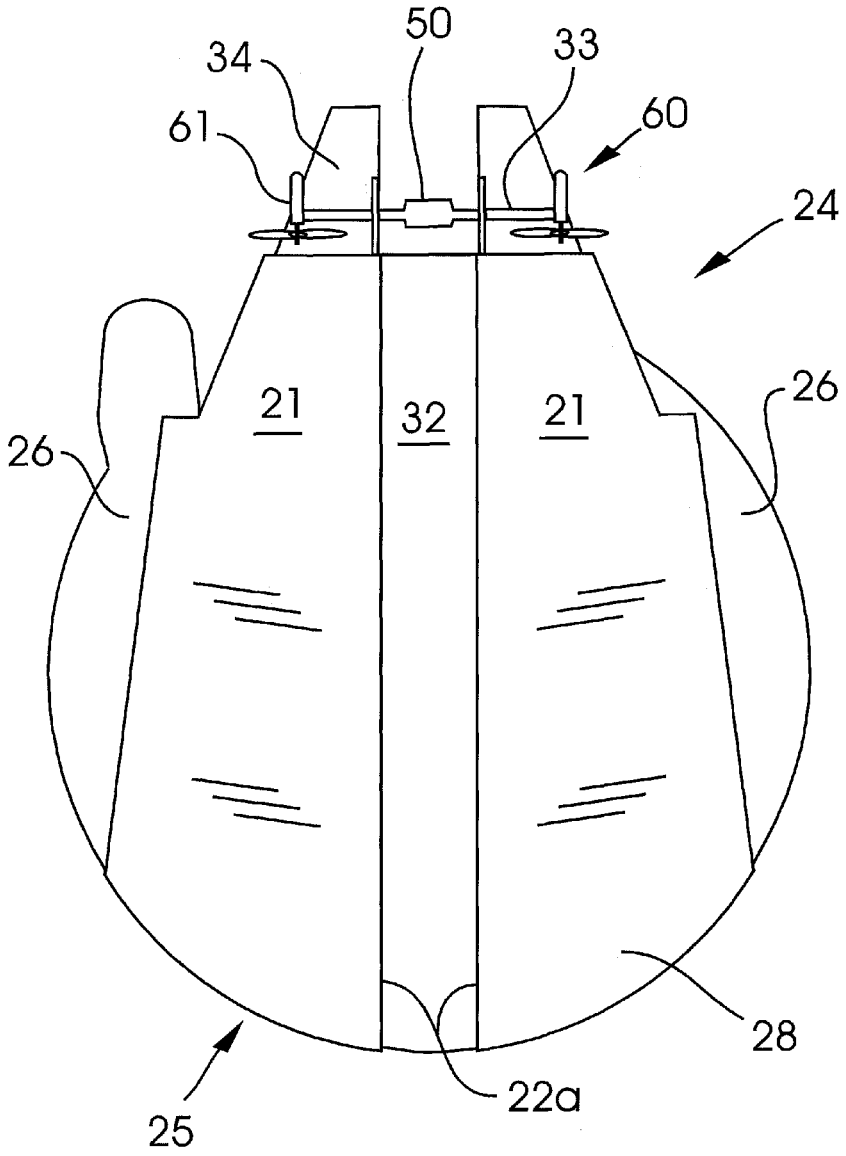
FIG. 11 is a bottom view of one embodiment of a flying toy spacecraft.

Referring to FIG. 11, the control system 50 comprises the electronic components for operation of the low pressure channel 20 or the flying toy spacecraft 1. The control system 50 typically comprises a receiver, a power source such as a battery, a circuit board, and other electronic components and wiring necessary to create electrical connectivity between the receiver, power source, and the propulsion units 61. These components of the control system 50 can be attached to a bracket member 33 (described below) or dispersed throughout the flying toy spacecraft 1 as desired. The control system 50 components can be housed in a nacelle to reduce aerodynamic drag caused by these components. In most embodiments, the control system 50 comprises components that are appreciated in the RC toy industry. The main components of the control system 50 are attached to the flying toy spacecraft 1 by tape, glue, screws, clips, or other suitable attachment materials or devices. The various components of the control system 50 can be placed as desired throughout the flying toy spacecraft 1 to balance a weight distribution or to control the overall center of gravity of the flying toy spacecraft 1.

In one embodiment of the operation of the flying toy spacecraft 1, the propulsion system 60 comprises two propulsion units 61. The propulsion units 61 are independently operable to promote a greater degree of steering and control by the user. For example, the user uses the wireless control device 5 (shown in FIG. 12) to send a signal to the receiver of the control system 50 to allocate more power or less power to a first propulsion unit 61. This increase or decrease in power causes a corresponding increase or decrease in the thrust produced by the first propulsion unit 61, thereby creating a thrust differential between the first propulsion unit 61 and a second propulsion unit 61. This thrust differential forces the toy spacecraft 1 to turn to in the opposite direction. For example, to make a turn to the right, the control system 50 allocates more power to the left propulsion unit 61 or less power to the right propulsion unit 61, thereby creating greater thrust on the left side of the body 10 and forcing the toy spacecraft 1 to turn to the right. A corresponding left turn is produced by producing more thrust from the right propulsion unit 61 or less power from the left propulsion unit 61.

The propulsion units 61 are attached to the body 10 or the low pressure channel 20 either directly or by a bracket member 33. The propulsion system 60 can comprise more than two propulsion units 61. However, the arrangement of propulsion units 61 should comprise at least one propulsion unit 61 attached to the flying toy FIG. 1 on each side of the longitudinal axis 11. The propulsion units 61 can be attached at angles that vary slightly from horizontal or vertical. For example, the propulsion units 61 could be angled slightly downward to provide a slightly upward lift angel produced by the thrust vector. Likewise, the propulsion units 61 could be angled slightly toward the longitudinal axis 11, or canted inward, to provide additional stability against yawing motion of the flying toy spacecraft 1.

In one embodiment of the flying toy spacecraft 1, the spacecraft 1 further comprises one or more leading wings 34 positioned at the leading section 24 for providing additional lift to the spacecraft 1 during flight.

Figure 13:
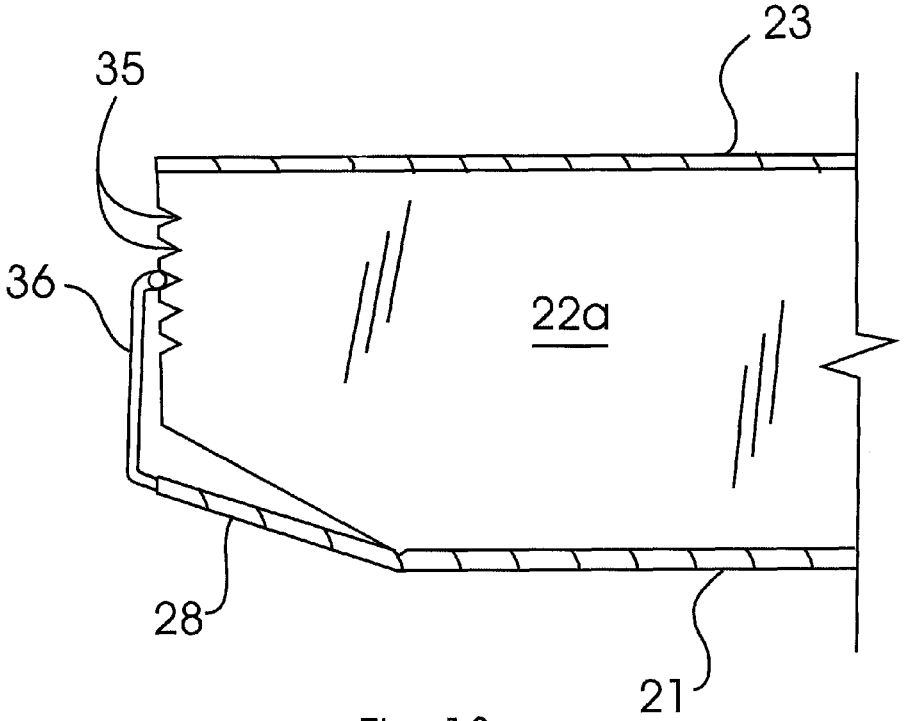
FIG. 13 shows the plurality of notches and the retaining member for retaining the reflexed edge of the low pressure channel at a desired orientation.

In another embodiment, shown in FIG. 13, the back edge of the interior sidewalls 22*a* further comprises a plurality of notches 35 for releasably receiving a retaining member 36 that is flexibly attached to the reflexed edge 28. Placing the retaining member 36 in one of the lower notches 35 places the reflexed edge 28 in a flatter orientation with respect to the base member 21, thus reducing the aerodynamic effect caused by the reflexed edge 28. In this orientation of the reflexed edge 28, the flying toy spacecraft 1 will assume a flight position that is flatter, meaning that the spacecraft 1 will be positioned with less pitch during flight. The speed of flight will also be relatively fast. By contrast, when the retaining member 36 is placed into one of the upper notches 35, the reflexed edge 28 is placed in a more pronounced angle with respect to the base member 21, thereby increasing the aerodynamic effect caused by the reflexed edge 28. In this orientation, the spacecraft 1 will fly with a more pronounced pitch at a slower speed.

In any of the embodiments disclosed herein, the flying toy spacecraft 1 can further comprise a shock absorbing member 37 attached to the leading section 24, as shown in FIG. 7. The shock absorbing member 37 is a flexible member that absorbs the impact force caused by crash landings or collisions of the spacecraft 1. The shock absorbing member 37 is made of a flexible wire, a flexible plastic member, a bumper or other such member. The shock absorbing member 37 is typically a thin member with a minimal aerodynamic profile so that the shock absorbing member 37 does not interfere with the flight characteristics of the flying toy spacecraft 1. In some embodiments, however, the shock absorbing member 37 comprises airfoil features that provide additional lift to the flying toy spacecraft 1 at the leading section 24.

Figure 14:
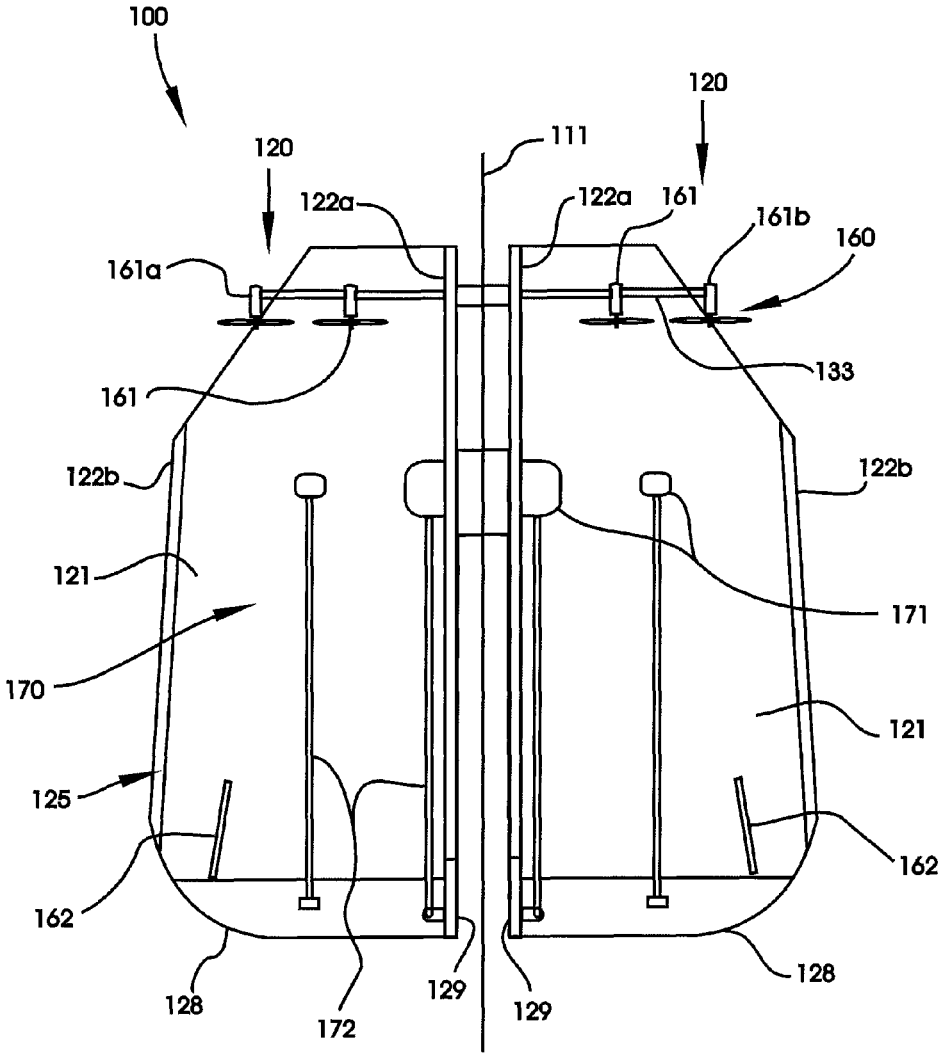
FIG. 14 is a top view of one embodiment of a flying vehicle without a top member in place.

In another embodiment, shown in FIG. 14, the low pressure channel 120 is incorporated into a flying vehicle 100 similar to the flying toy spacecraft 1 described above. However, the flying vehicle 100 is not configured to be used as a toy, but rather as an RC drone. In this embodiment, the flying vehicle 100 comprises one or more low pressure channels 120, a control system 150, a propulsion system 160, and a servo system 170. Each of the low pressure channels 120 comprises a base member 121 and at least two sidewalls 122. In multi-channel configurations, the sidewalls 122 are either interior sidewalls 122*a* or exterior sidewalls 122*b*. The low pressure channels 120 further comprise a top member 23 and lateral wings 26 (not shown in FIG. 21) in a manner similar to that disclosed above in relation to the flying toy vehicle 1, which will be appreciated by an ordinary practitioner. The base member 121 further comprises a reflexed edge 128, and at least one of the sidewalls 122 comprises a rudder member 129.

The control system 150 comprises the electronic components for operation of the flying vehicle 100 as described above. The propulsion system 160 comprises at least two propulsion units 161. The propulsion units 161 are independently operable to promote a greater degree of steering and control by the user. For example, the user uses the wireless control device 5 (shown in FIG. 19) to send a signal to the receiver of the control system 150 to allocate more power or less power to a first propulsion unit 161*a* located on one side of the longitudinal axis 111. This increase or decrease in power causes a corresponding increase or decrease in the thrust produced by the first propulsion unit 161*a*, thereby creating a thrust differential between the first propulsion unit 161*a* and a second propulsion unit 161*b*, which is located on the opposite side of the longitudinal axis from that of the first propulsion unit. This thrust differential forces the flying vehicle 100 to turn to in the opposite direction. In one exemplary embodiment, to make a turn to the right, the control system 150 allocates more power to the first propulsion unit 161*a* or less power to the second propulsion unit 161*b*, thereby creating greater thrust on the left side of the flying vehicle 100 and forcing the flying vehicle 100 to turn to the right. A corresponding left turn is produced by producing more thrust from the second propulsion unit 161*b* or less power from the first propulsion unit 161*a*.

The propulsion units 161 are attached to the flying vehicle 100 either directly or by a bracket member 133. The propulsion system 160 can comprise more than two propulsion units 161. However, the arrangement of propulsion units 161 should comprise at least one propulsion unit 161 attached to the flying vehicle 100 on each side of the longitudinal axis 111.

Another embodiment of the low pressure channels 120 further comprises one or more baffles 162 that act as rudders internal to the low pressure channel 120. In one embodiment, the baffles 162 are positioned in the trailing section 125 of the low pressure channels 120. The baffles 162 should be placed symmetrically about the longitudinal axis 111 and canted slightly outward away from the longitudinal axis 111 such that the baffles 162 provide additional stability against undesired or excessive yawing motion of the fling vehicle 100. This orientation of the baffles 162 also enhances the turning agility of the flying vehicle 100 in embodiments where turning is actuated by a thrust differential in the propulsion units 161, as described above. More specifically, when the thrust of the first propulsion unit 161*a* is greater than the thrust of the second propulsion unit 161*b* to produce a right turn of the flying vehicle, the speed of airflow through left low pressure channel 120 is greater than the speed of airflow through the right low pressure channel 120. In this state of airflow, the baffles 162 in the left low pressure channel 120 produce a greater aerodynamic effect than the baffles 162 in the right low pressure channel 120. The baffles 162 in the left low pressure channel 120 therefore act as a rudder that assists in turning the flying vehicle 100 in the desired direction.

The baffles 162 can be configured to extend the full height of the low pressure channel 120 all the way from the base member 121 to the top member. Alternatively, the baffles 120 could be attached to either the base member 121 or the top member 23 and extend for only part of the height of the low pressure channel 120.

The servo system 170 comprises one or more servo motors 171 for actuating one or more servo actuators 172. The servo system 170 is powered and electronically controlled by the control system 150, which is placed in electronic communication with the servo system 170 either by wired connectivity or wireless connectivity. The servo actuators 172 are connected to the control mechanisms of the flying vehicle 100, such as the reflexed edge 128 and the rudder member 129. The servo system 170 actuates these control mechanisms to provide additional control of the flying vehicle 100 during flight. The servo system 170 can be configured to work in connection with or independently from the thrust differential steering mechanism of the propulsion system 160 described above.

The foregoing embodiments are merely representative of the flying toy spacecraft and not meant for limitation of the invention. For example, persons skilled in the art would readily appreciate that there are several embodiments and configurations of wing members, low pressure channels, and other components will not substantially alter the nature of the flying toy spacecraft. Likewise, elements and features of the disclosed embodiments could be substituted or interchanged with elements and features of other embodiments, as will be appreciated by an ordinary practitioner. Consequently, it is understood that equivalents and substitutions for certain elements and components set forth above are part of the invention described herein, and the true scope of the invention is set forth in the claims below.

I claim:

1. A flying toy spacecraft comprising:

a body having a leading section, a trailing section, and one or more low pressure channels disposed below a top member, each low pressure channel defined by a base member and a sidewall, and the top member comprising a mesh member;

a control system; and a propulsion system.

2. The flying toy spacecraft of claim 1, wherein at least one low pressure channel comprises an airfoil attached to the base member in proximity to the leading section, and a reflexed edge disposed in the base member in proximity to the trailing section.

* * * * *